United States Patent [19]

Badali

[11] 4,109,403

[45] Aug. 29, 1978

[54] DETACHABLE BARREL FOR HAND GUNS

[75] Inventor: Joseph A. Badali, Mountain Green, Utah

[73] Assignee: Browning Arms Company, Morgan, Utah

[21] Appl. No.: 616,618

[22] Filed: Sep. 25, 1975

[51] Int. Cl.[2] ..... F41C 21/00

[52] U.S. Cl. ..... 42/75 B

[58] Field of Search ..... 42/75 B, 75 A, 75 C

[56] References Cited

U.S. PATENT DOCUMENTS

| | | | |
|---|---|---|---|
| 1,227,668 | 5/1917 | Reising | 42/75 C |
| 2,817,174 | 12/1957 | Liedke | 42/75 B |
| 2,958,974 | 11/1960 | Sefried | 42/75 B |
| 3,150,458 | 9/1964 | Browning | 42/75 B |
| 3,183,617 | 5/1965 | Roger et al. | 42/75 B |

*Primary Examiner*—Charles T. Jordan
*Attorney, Agent, or Firm*—Trask & Britt

[57] ABSTRACT

An automatic pistol is constructed with a more or less conventional frame and more or less conventional barrel detachably mounted to the frame. The frame and barrel have interfitting portions in cooperative engagement to support the barrel in longitudinal alignment on the frame. The frame is provided with a seating surface for the bottom of the barrel, an abutment surface against which the breech end of the barrel abuts, and a well, forward of the abutment surface, into which a barrel block loosely fits. The barrel block is attached to depend from the barrel. A longitudinal bore through the barrel block partially registers with a corresponding threaded bore through the frame forward of the barrel block. The forward opening of the bore in the barrel block is countersunk, and the axis of this bore is slightly above the axis of the threaded bore with respect to the axis of the barrel. A screw with a tapered end is threaded through the threaded bore to engage the barrel block bore, thereby urging the barrel down onto the seating surfaces and back toward the abutment surface of the frame.

3 Claims, 3 Drawing Figures

DETACHABLE BARREL FOR HAND GUNS

BACKGROUND OF THE INVENTION

1. Field

This invention relates to hand guns, notably automatic pistols, and provides an improved mechanism for positively securing the barrel of an automatic pistol to its frame in a detachable manner.

2. State of the Art

Hand guns such as automatic pistols with detachable barrels are well known. A principal problem encountered with such guns is misalignment of the barrel upon the frame, particularly after extensive usage. It is of course desirable for the barrel-mounting means to facilitate installation and removal, even by one who is unskilled, so as to enable interchanging of barrels without special tools. Many of the firearms of this type known to the prior art have insufficient rigidity of support for the barrel upon the frame, and thus fail to secure proper alignment after continuous operation without adjustment. Moreover, it has been found that after prolonged use, wear of parts effects a loosening of the barrel on the frame thereby contributing to misalignment after extensive usage.

An example of a high quality firearm with a detacbable barrel is that described in U.S. Pat. No. 3,150,458. The automatic piston therein disclosed has a frame and a barrel, each of which has longitudinally extending interfitting portions in cooperative engagement for supporting the barrel in longitudinal alignment on the frame. The barrel is held to the frame with positive retention means including a screw which is inserted through a bore in the frame to threadedly engage a lug depending from the barrel into a recess in the frame. The lug further carries a transverse pin with end portions which engage a groove in the frame so that as the screw is threaded into the lug the barrel is urged down and forward on the frame. Although this action permits adjustment of the barrel to maintain seating of the barrel on the frame after use, movement of the barrel downward automatically results in a slight forward movement of the barrel with respect to the receiver and slide of the firearm. The bolt of the pistol moves forward to maintain a proper seal at the breech, but provision must be made at the time of manufacture to avoid mismating or misalignment of parts as a consequence.

A more recent example of a detachable barrel mounting system in an automatic pistol is that of the "High Standard" target pistols produced by the Leisure Group, Inc., 1817 Dixwell Avenue, Hamden, Connecticut, wherein the barrel is provided with a depending cylindrical leg which is inserted through a matching cylindrical bore milled vertically through the surface of the frame upon which the bottom side of the barrel is intended to seat. The leg is inserted through a bore in a spring-biased plunger carrying a ramped slot which in turn engages a milled surface in the depending leg. In this fashion the barrel is continuously urged down toward the seating surfaces of the frame by spring pressure upon the cylindrical member. This arrangement provides for quick assembly and take-down of the pistol, and it maintains the longitudinal position of the barrel with respect to the frame, assuming the tolerances of the leg and bore are held sufficiently close. This structure imposes high tolerance requirements on the manufacturer, however. Moreover, the tendency of the spring pressure arrangement is to urge the barrel not only down but forward with respect to the frame. Thus, any wear on the attachment surfaces will be taken up by slight movement of the barrel forward away from the breech.

There remains a need in the art for a rapid attachment system to secure the barrel of an automatic pistol to its frame in a fashion which minimizes the opportunity for loosening either initially or after prolonged usage of the firearm. There is further a need for such a system with decreased tolerance requirements at the point of manufacture.

SUMMARY OF THE INVENTION

The present invention provides an improved assembly for releasably attaching a barrel assembly to a frame assembly of an automatic pistol. The firearm of this invention is constructed generally in the same fashion as that described in U.S. Pat. No. 3,150,458, the disclosure of which is hereby incorporated by reference to the extent it is applicable hereto. Although the attachment system of this invention is useful with automatic pistols of other constructions, the structure and operation of the pistol disclosed by that patent is an example of the structure and operation with which this invention is intended for use.

In general, the automatic pistols with which this invention may be utilized are those which have detachable barrel assemblies which are adapted for mounting upon a frame which carries seating surfaces adapted to interface with surfaces on the barrel to align the barrel on the frame. The seating surfaces provide rigid support and restrain the barrel against pivotal and lateral movement on the frame. The requirement of the prior art that the barrel and frame be connected in rigid longitudinal alignment (so that any longitudinal movement of the barrel on the frame would not affect the alignment of the barrel with the slide portions of the automatic pistol) is less critical by virtue of the structure of this invention, as will be more fully explained hereinafter.

In contrast to the automatic pistols previously discussed, the present invention provides a mounting system whereby the barrel is forced back into the frame as well as down to seat upon the mounting surfaces of the frame. The mechanism by which this is accomplished includes a barrel block integral with and depending from the barrel into a recess or well provided in the frame. A shoulder (abutment surface) is provided in the frame against which the barrel abuts at a location beneath the chamber, thereby holding the chamber in precise position with respect to the breech and action of the pistol. The barrel block is thus located to register in a loose fit arrangement with the well in the frame. An important aspect of this invention is that the well itself need not be relied upon as a registration or indexing means for the barrel with respect to the frame. Thus, close tolerances are not required.

Means are provided in cooperation with the frame to engage the barrel block in a fashion which tends to urge it down and back with respect to the well, thereby forcing the barrel down upon the seating surfaces of the frame as well as back against the shoulder of the frame. These means may take various forms but ideally comprise a screw with a frusto conical head portion threaded through the frame to engage a countersunk bore in the barrel block. The barrel block bore desirably has an axis slightly closer the axis to the barrel than the axis of the screw. Thus, as the screw is advanced towards the barrel block, it engages the bottom surface of the countersunk bore to force the barrel in the desired directions. The misalignment of the bores in the barrel block and frame, respectively, tends to bias the screw, thereby locking it in place. The screw thus provides an easy means to insure a tight fit after intermittent short or long periods of use, as well as an extremely simple means to detach the barrel from the frame.

BRIEF DESCRIPTION OF THE DRAWINGS

In the drawings which illustrate what is presently regarded as the best mode for carrying out the invention.

DESCRIPTION OF THE ILLUSTRATED EMBODIMENT

Figure 1:
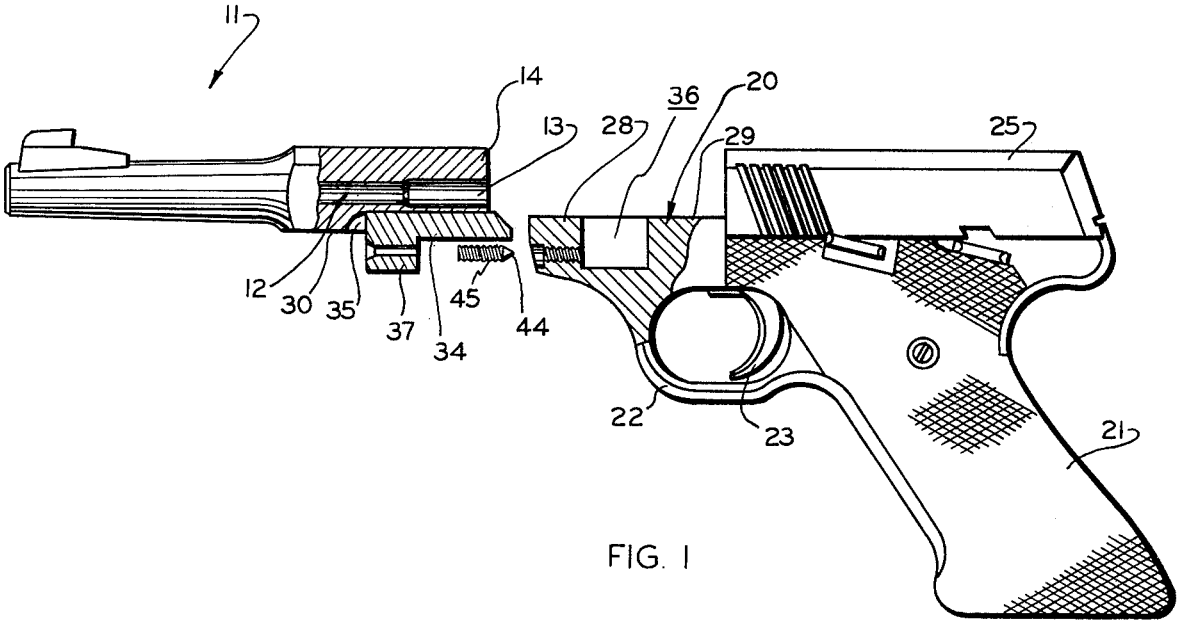
FIG. 1 is a partially exploded side view of an automatic pistol incorporating the invention.
Figure 2:
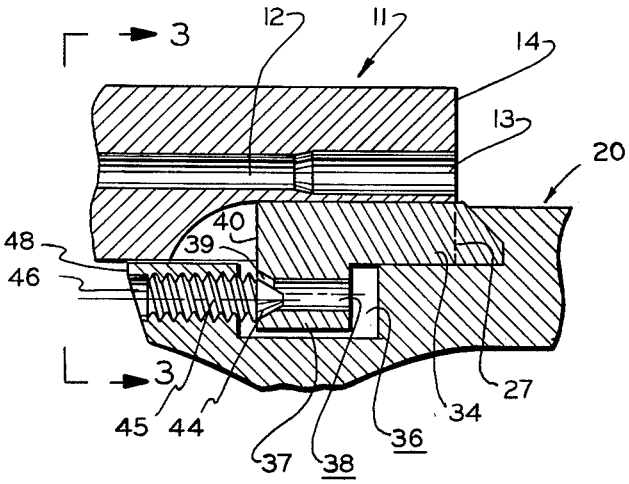
FIG. 2 is a fragmentary longitudinal cross-sectional view of the barrel showing the invention in assembled condition.
Figure 3:
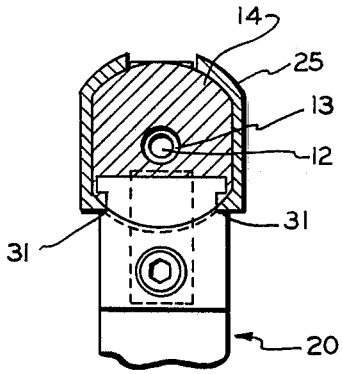
FIG. 3 is a transverse cross-sectional view of the pistol taken along the line 3—3 of FIG. 2 and viewed in the direction of the arrows.

Referring to the drawings, the invention is shown as embodied in an automatic pistol having a barrel 11 with a bore 12 enlarged as a chamber 13 at its breech end 14. FIGS. 2 and 3 illustrate the barrel mounted upon a more or less conventional frame 20 which, as shown in greater detail in FIG. 1, includes a grip portion 21, trigger guard 22 and trigger 23 pivotally mounted on the frame for operating the internal mechanism involved with firing the gun. The frame also carries a slide 25, conventional in automatic pistols, which is supported in alignment with the barrel 11 for movement in recoil to eject a spent round from the firing chamber 13 and for movement forward by action of a recoil spring (not shown) against the breech face 14 of the barrel to seal a new cartridge into the chamber, preparatory for a subsequent firing.

With the barrel positioned appropriately on the frame 20 as shown in FIG. 2, the lower portion of the breech face 14 of the barrel abuts snuggly against a shoulder surface 27 (shown in phantom line in FIG. 2) of the frame. To provide firm support for the barrel 11 on the frame 20 and to maintain the barrel and its bore 12 in precise longitudinal alignment on the frame 20, the upper forward and rear surfaces 28, 29 of the frame are channeled to support the lower longitudinal surface 30 of the barrel 11 along parallel contact edges 31 (FIG. 3). These edges 31 provide a firm seat for the barrel upon the frame and hold the barrel in precise longitudinal alignment with the frame 11 and slide 25.

According to this invention, the barrel is correctly seated with respect to the frame by merely placing the barrel against the abutment surface 27 and allowing the barrel 11 to drop upon the seating edges 31 of the frame 20. A barrel block 34, shown silver soldered within a slot 35 in the bottom of the barrel, is thus brought into position within a receiving well 36 in the frame 20. As illustrated, the depending portion 37 of the block 34 within the well 36 is entirely out of contact with any of the side walls or bottom of the well 36.

The depending leg 37 of the barrel block is provided with a bore 38 having a countersunk portion 39 on its forward surface 40. The frusto conical end 44 of a threaded screw 45 engages the countersunk portion 39 of the bore 38 as shown in FIG. 2. The screw 45 is threaded through a bore 46 provided in the front surface 48 of the frame 20. As is apparent from the drawing, the axis of the bore 46 and the screw 45 is somewhat lower with respect to the barrel than is the axis of the bore 38. Accordingly, advancement of the tapered end 44 (camming surface) of the screw 45 into the countersunk portion 39 of the bore 38 forces (cams) the barrel block 34 down and to the rear so that the barrel surface 30 is brought to bear against the frame surfaces 28, 29 along edges 31 while the barrel surface 14 is brought to bear against the frame surface 27. In this fashion, an absolutely tight and secure registering of the barrel 11 to the frame 20 and the chamber 13 against the slide 25 is assured through the operation of a single screw 45. This registration is assured without imposing severe tolerance requirements on the attachment means. The forces acting on the screw 45 by virtue of the axial misalignment of the bores 38 and 46 assure self locking of the screw 45 so that it remains tightly in place even after prolonged use.

Although this invention has been described by reference to details of the illustrated embodiment, it is not intended thereby to restrict the scope of the claims which themselves recite those features regarded as essential to the invention. It should be recognized that departures from the illustrated structure, which may readily be devised by those skilled in the art, will nevertheless incorporate the inventive aspects set forth in this disclosure.

I claim:

1. In a firearm of the type having a frame, a detachable barrel mounted in longitudinal alignment on the frame and means for positively connecting the barrel to the frame, the improvement which comprises:

a well in said frame beneath the chamber end of said barrel;

a barrel block extending down into said well from attachment to said barrel, said barrel block being in loose fit relation with said well and having a bore in approximately parallel relation with said barrel and countersunk at the forward surface of the barrel block;

a threaded bore through the forward surface of the frame in open communication with said well and in approximately parallel alignment with the bore in said barrel block but with its axis lower with respect to said barrel than the axis of the bore in said barrel block; and a barrel screw threaded through said threaded bore with a tapered lead end in engagement with said countersunk portion of the bore in said barrel block, thereby to urge said barrel down and back with respect to said frame.

2. In an automatic pistol of the type having a frame and a detachable barrel mounted in longitudinal alignment on the frame through interfitting surfaces adapted to retain the bore of the barrel in precise longitudinal alignment with respect to said frame, the improvement which comprises:

a shoulder surface on said frame located to constitute means of abutment for a portion of said barrel beneath the chamber thereof;

structure depending from said barrel forward of said shoulder surface; and means carried by said frame cooperatively adapted with said depending structure to engage said structure and urge it down and back with respect to the frame thereby to positively secure the barrel to the frame and positively force the barrel back to said shoulder surface.

3. The improvement of claim 2 wherein the depending structure includes a leg projecting down into a well carried by the frame and having a longitudinal bore with a camming surface at its forward end and the means for securing the barrel to the frame is a threaded screw with a leading end configurated to engage the camming surface of the bore in the leg.

* * * * *